US005829884A

United States Patent [19]

Yeager

[11] Patent Number: 5,829,884

[45] Date of Patent: Nov. 3, 1998

[54] FORM FILL AND SEAL PACKAGE WITH ONE-WAY VENT

[75] Inventor: James W. Yeager, Mobile, Ala.

[73] Assignee: Innoflex Incorporated, Mobile, Ala.

[21] Appl. No.: 879,262

[22] Filed: Jun. 19, 1997

[51] Int. Cl.[6] ..... B65D 33/16; B65D 33/01

[52] U.S. Cl. ..... 383/61; 383/63; 383/66; 383/103; 383/203; 383/207; 383/210

[58] Field of Search ..... 383/61, 63, 64, 383/65, 66, 210, 211, 207, 209, 203, 204, 100, 101, 103

[56] References Cited

U.S. PATENT DOCUMENTS

| | | |
|---|---|---|
| Re. 29,043 | 11/1976 | Naito . |
| 998,967 | 7/1911 | Gleitverschluss . |
| 2,978,769 | 4/1961 | Harrah . |
| 3,172,443 | 3/1965 | Ausnit . |
| 3,181,583 | 5/1965 | Lingenfelter . |
| 3,266,965 | 8/1966 | Spees . |
| 3,338,285 | 8/1967 | Jaster . |
| 3,405,861 | 10/1968 | Bush . |
| 3,426,959 | 2/1969 | Lemelson . |
| 3,440,696 | 4/1969 | Staller . |
| 3,449,888 | 6/1969 | Gausman . |
| 3,473,589 | 10/1969 | Gotz . |
| 3,532,571 | 10/1970 | Ausnit . |
| 3,543,343 | 12/1970 | Staller et al. . |
| 3,570,375 | 3/1971 | Williams et al. . |
| 3,608,439 | 9/1971 | Ausnit . |
| 3,685,562 | 8/1972 | Ausnit . |
| 3,717,244 | 2/1973 | Smith . |
| 3,789,888 | 2/1974 | James et al. . |
| 3,827,472 | 8/1974 | Uramoto . |
| 3,948,705 | 4/1976 | Ausnit . |
| 4,020,884 | 5/1977 | Jadot . |
| 4,046,408 | 9/1977 | Ausnit . |
| 4,094,729 | 6/1978 | Boccia . |
| 4,241,865 | 12/1980 | Ferrell . |
| 4,285,105 | 8/1981 | Kirkpatrick . |
| 4,332,344 | 6/1982 | Strodthoff . |
| 4,335,817 | 6/1982 | Bahr . |
| 4,341,575 | 7/1982 | Herz . |
| 4,354,541 | 10/1982 | Tilman . |
| 4,355,494 | 10/1982 | Tilman . |
| 4,372,793 | 2/1983 | Herz . |
| 4,401,213 | 8/1983 | Lerner . |
| 4,430,070 | 2/1984 | Ausnit . |
| 4,449,962 | 5/1984 | Copia . |

(List continued on next page.)

FOREIGN PATENT DOCUMENTS

| | | |
|---|---|---|
| 719570 | 12/1963 | Canada . |
| 452 430 | 12/1966 | Denmark . |
| 485 741 A1 | 10/1991 | European Pat. Off. . |
| 528 721 A@ | 8/1992 | European Pat. Off. . |
| 1031136 | 1/1951 | France . |
| 1079480 | 6/1953 | France . |
| 1423849 | 11/1964 | France . |
| 54-39218 | 3/1979 | Japan . |

*Primary Examiner*—Jes F. Pascua
*Attorney, Agent, or Firm*—Rockey, Milnamow & Katz, Ltd.

[57] ABSTRACT

A package in the form of a reclosable bag includes a bag body including front and back walls, and a profile strip fastener assembly sealingly mounted on the inside surface of the front wall, and a one-way vent incorporated into the bag sealing arrangement. The profile strip fastener assembly includes a pair of releasably interlocking profile strips, with a secondary, peelable seal provided between the profile strips apart from their mechanically interlocked portions. The bag body preferably includes a frangible joint substantially aligned with the fastener assembly for gaining access to the assembly, with the frangible joint desirably providing tamper-evidence of opening of the package. The profile strips are sealed to the front wall of the bag body with a continuous oval shaped seal around the frangible joint, except for a gap which in part defines the vent. Gas pressure caused by evolving gas within the bag is relieved through the vent, while a portion of one of the profile strips or a portion of the bag wall, unsecured across the gap closes the gap to prevent air from passing into the bag.

26 Claims, 6 Drawing Sheets

U.S. PATENT DOCUMENTS 4,479,244 10/1984 Ausnit .
4,532,652 7/1985 Herrington ..... 383/63 X
4,555,282 11/1985 Yano .
4,570,820 2/1986 Murphy .
4,582,549 4/1986 Ferrell .
4,601,694 7/1986 Ausnit .
4,617,683 10/1986 Christoff .
4,619,021 10/1986 Johnson .
4,655,862 4/1987 Christoff et al. .
4,663,915 5/1987 Van Erden et al. .
4,666,536 5/1987 Van Erden et al. .
4,691,373 9/1987 Ausnit .
4,709,398 11/1987 Ausnit .
4,709,533 12/1987 Ausnit .
4,756,629 7/1988 Tilman et al. .
4,782,951 11/1988 Griesbach et al. .
4,790,126 12/1988 Boeckmann .
4,840,611 6/1989 Van Erden et al. .
4,848,928 7/1989 Ausnit .
4,892,414 1/1990 Ausnit .
4,894,975 1/1990 Ausnit .
4,896,775 1/1990 Boeckmann et al. .
4,902,140 2/1990 Branson .
4,909,017 3/1990 McMahon et al. .
4,925,315 5/1990 Van Erden et al. .
4,925,318 5/1990 Sorensen .
4,969,967 11/1990 Sorensen et al. .
4,993,844 2/1991 Robinson et al. .
5,022,530 6/1991 Ziecke .
5,024,537 6/1991 Tilman .
5,036,643 8/1991 Bodolay .
5,050,736 9/1991 Griesbach et al. .
5,059,036 10/1991 Richison et al. .
5,063,069 11/1991 Van Erden et al. .
5,096,516 3/1992 McDonald et al. .
5,116,140 5/1992 Hirashima .
5,121,997 6/1992 La Pierre et al. ..... 383/63 X
5,157,811 10/1992 Bodolay .
5,167,608 12/1992 Steffens, Jr. et al. .
5,186,543 2/1993 Cochran .
5,188,461 2/1993 Sorensen .
5,419,638 5/1995 Jamison .
5,461,845 10/1995 Yeager .
5,601,368 2/1997 Bodolay et al. .

10
20
56
41
51
51b
51a
51c
16
44
30
42a
16
55
36
42
42b
43
40a
40
28
60
32
26
18

10
59
51
58a
57
58
55
60
1A
2
1E
53a
44
20
41
24
52
41
1B
53
12
18
1D
50
40
48
62
26
28
32
36
30
42
1B
1D
1A
2
1E
62a
43
52c
48
16
22
14

FORM FILL AND SEAL PACKAGE WITH ONE-WAY VENT

TECHNICAL FIELD

The present invention relates generally to flexible bag-like packages, and more particularly to a flexible reclosable bag package including a sealing arrangement for a profile strip fastener assembly mounted on a front wall of the body of the bag, and a venting arrangement for gas evolved within the bag.

BACKGROUND OF THE INVENTION

Reclosable packaging is particularly suited for packaging of food products when it is desired to repeatedly remove relatively small quantities of the food product. Such food products include cereals, rice, candies, and the like, and may also include meat food products, such as chicken, frankfurters, sliced meats, etc. While the use of reclosable flexible bags having twist-tie wire fasteners or plastic clasps has long been known, recent advents in reclosable packaging have included configuring packages to have integral zipper-type fastener assemblies, including interlocking profile strips. In such arrangements, the package is typically opened by cutting or tearing a portion of the package to gain access to the fastener assembly, with opening and closing of the profile strips of the fastener assembly thereafter permitting the package to be selectively opened and closed.

While packages having integrated profile strip fastener assemblies are becoming common in the marketplace, heretofore, such arrangements have typically require specialized packaging machinery for forming and filling such packages. Significantly, U.S. Pat. No. 5,461,845 discloses a reclosable package, and method of formation, which is specifically configured to facilitate use on conventional, so-called form, fill, and seal machinery. This type of machinery forms and fills packages with food product (or other articles) by forming a package from a web of plastic material or the like, and substantially simultaneously filling and sealing the package. The package disclosed in the above-referenced patent includes a profile strip fastener assembly which is configured such that a plurality of fastener assemblies can be provided on a substantially continuous web of package-forming material, with the web then stored in rolled or fan-folded form prior to use. The web of packaging material can then be supplied to a conventional form, fill, and seal machine, with the machine operated in a generally conventional manner to package the product as desired. By the provision of the profile strip fastener assembly in the front wall portion of the package, convenient reclosability of the package is provided without resort to twist-tie fasteners, plastic clasps, or the like. The above-referenced patent is hereby incorporated by reference.

Some products, such as coffee beans, evolve carbon dioxide gas when packaged immediately after being roasted. The coffee beans can generate sufficient carbon dioxide gas to expand the package to the point of rupture. As a result, some known coffee bean packages utilize a valve for releasing or venting this gas.

In the case of coffee beans, the carbon dioxide is only released during a portion of the shelf-life of the coffee. After this period of time the coffee beans begin to absorb oxygen within the package, and as a result, the pressure in the package eventually decreases to below atmospheric pressure. This drop in pressure within the package potentially changes the direction of gas flow from gas export out of the package to the ambient air, to gas import into the package from the ambient air. It is also desirable to prevent the outside air from entering the package through the valve, such outside air which tends to spoil the product.

In a typical prior art carbon dioxide vent, the vent is applied as an attachment to the bag or made into the bag during the final bag making process. Prior art vent arrangements are described in U.S. Pat. Nos. 5,059,036 and 5,419,638.

The present invention contemplates a reclosable package in the form of a bag which is configured for use with conventional form, fill and seal machinery, while providing enhanced sealed integrity for the package as well as tamper-evidence of opening. The present invention contemplates a venting arrangement readily incorporated into the bag construction.

SUMMARY OF THE INVENTION

A package in the form of a reclosable bag embodying the principles of the present invention includes a profile strip fastener assembly which is joined to a front wall of a bag body in a manner which permits formation of the bag in web form prior to use with a conventional form, fill and seal machine. The package of the invention, in the form of a bag, includes a one-way vent arrangement as part of the profile strip fastener assembly and/or its attachment to the bag, for releasing gas pressure from within the bag while preventing ingress of air into the bag.

The profile strip fastener assembly also includes a peelable seal, in addition to the closure formed by the interlocking profile strips of the assembly, thus enhancing the sealing integrity of the fastener assembly during package formation, filling, and subsequent storage and use. An arrangement for securing the profile strip fastener assembly to the front wall of the bag body can be desirably configured to effect hermetic (i.e., substantially air-tight) sealing of an associated perforated region of the front wall which provides access to the contents of the package. Oxygen barrier packaging can be produced in accordance with the principals disclosed herein by the provision of profile strip assemblies and bag film materials exhibiting oxygen-barrier properties.

In accordance with the illustrated embodiment, the present reclosable bag includes a bag body formed from a rectangular sheet of film material, such as plastic film material or the like. The bag body has a top end, a bottom end, a front wall, and a back wall, wherein the front wall is joined to the back wall by upper and lower seams respectively provided at the top and bottom ends of the bag body.

A reclosable profile strip fastener assembly is joined to the front wall of the bag body-and comprises first and second interlocking profile strips which respectively extend along the length of the fastener assembly. The profile strips are configured for releasable interlocking engagement with each other by the provision of at least one elongated protuberance on one of the profile strips, and at least one groove defined by the other of the profile strips for respectively releasably receiving the protuberance.

In a first embodiment, the fastener assembly is specifically configured for independent securement to the inside surface of the front wall of the bag body, and to this end, the first profile strip of the assembly includes a body flange portion joined to an inside surface of the front wall. Similarly, the second profile strip includes another body flange portion joined to the inside surface of the front wall of the bag body. In a second embodiment, the second profile strip comprises a fastener body secured directly to the inside surface of the front wall of the bag body, without use of a body flange portion.

In order to enhance the sealing integrity of the fastener assembly, and to better carry loads to which the assembly is subjected during formation, filling, shipment, and storage of the package, one of the profile strips of the fastener assembly includes a seal flange portion, with the assembly including a seal formed between the seal flange portion of the one profile strip, and the body flange portion of the other one of the profile strips. In this manner, the seal must be opened to provide access to the opening between the first and second profile strips when they are released from interlocking engagement with each other.

In the preferred embodiment, the front wall of the bag body includes an elongated, frangibly openable joint which is substantially aligned with the fastener assembly. This openable joint provides access to the seal and interlocking profile strips of the fastener assembly after the joint is opened on the front wall of the bag body. The provision of this openable joint in the bag body desirably provides tamper-evidence of opening of the bag. The first and second profile strips are sealed to the front wall with a substantially continuous seal which closely surrounds the joint, except for the provision of a vent as described below, and which can be configured to effectively hermetic seal the perforation which preferably defines the joint. The second profile strip can also be sealed along its bottom edge region to the bag front wall.

Providing the surrounding seal in close proximity to the joint creates a secure and hermetically sealed bag. A reduced sealing region is required. The second profile strip is held more securely to the front wall which facilitates reclosing of the bag using the profile strips. Also, the second profile strip is closed at its top end to the front wall, preventing trapping of small particles behind the second profile strip.

At an end of the profile strip assembly, the peelable seal extends from one end of the assembly to a position located at a short distance from an opposite end of the profile strip assembly. The substantially continuous seal of the profile strip assembly includes an upper seal, end seals, and an intermediate seal. The upper and intermediate seals extend across a width of the bag, which is along the length of the profile strips. The upper seal extends from one end seal to the respective opposite end seal. The intermediate seal, however, extends from the one end seal but terminates at a position at a short distance from the opposite end seal. A vent passage is created between the intermediate seal and the respective opposite end seal across the short distance, due to the fact that between the intermediate seal and the opposite end seal the profile strip assembly is not fixed to the bag wall, either by the intermediate seal or by the peelable seal.

The vent passage receives gas from the bag interior through a gas bypass opening located on an outside or above the interlocking engagement provided by the profile strips. Such bypass opening can be provided at the end seals where the profile strips are sealed together or by a hole through a body flange portion of one of the profile strips. A vent opening is provided on the bag wall in gas flow communication with the vent passage. The vent opening can be in the form of perforations which also serve the purpose of creating a frangible joint which can be separated to give access into the bag, i.e., to the interlocking engagement of the profile strips. Thus gas evolved within the bag proceeds through the bypass opening, through the vent passage, and out through the vent opening.

The vent is designed as a one-way valve which closes up when the pressure within the bag falls below atmospheric pressure. By leaving a portion of one of the profile strips unsecured in the vent passage, this portion of the profile strip acts as a valve element which, under net external pressure, or net internal vacuum, squeezes closed the vent passage, or alternatively the vent hole, to prevent ingress of air into the bag.

Through utilizing the vent design of the present invention, it is possible to produce a package at a low cost with a built in one-way vent by the form, fill and seal process. The one-way vent is supplied as part of the reclosable fastener assembly pre-installed on film stock for use on form, fill and seal machines. Therefore, unlike the prior art, the vent does not need to be made into the package during the final bag or pouch making process, nor does the vent need be attached in a separate, subsequent step.

The inventive reclosable bag allows for a more efficient packaging of gas generating products by utilizing a conventional form, fill and seal machine. The form, fill and seal machine used need not have the capability of forming the one-way vent, since the packaging film can be supplied with the vent as a preformed structure.

Other features and advantages of the present invention will become readily apparent from the following detailed description, the accompanying drawings, and the appended claims.

DETAILED DESCRIPTION OF THE PREFERRED EMBODIMENTS

Figure 1A:
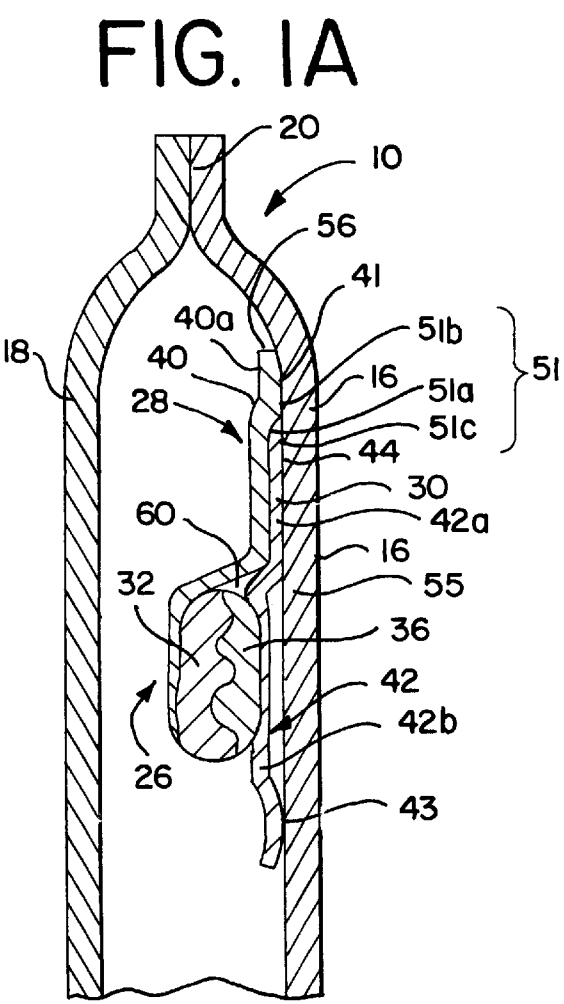
FIG. 1A is a fragmentary sectional view taken along line 1A—1A of FIG. 1.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiments illustrated and described.

With reference now to the drawings, therein is illustrated a package in the form of a reclosable bag 10 embodying the principles of the present invention. It is contemplated that the bag 10 be formed from suitable plastic film materials or the like, but it is within the purview of the present invention to form the bag from paper or paper-like materials. As will hereinafter be described, bag 10 is specifically configured in a manner which facilitates formation of the bag from a substantially continuous web of film material, to which fastener assemblies have been previously applied, for use in a so-called form, fill, and seal apparatus for packaging of food products, or non-food products. For example, the present package can be configured for packaging of non-food items such as hardware articles or the like, wherein repeated opening and closing of the package is desired.

The reclosable bag 10 is formed from a generally rectangular sheet of film material, and includes a top end generally designated 12, a bottom end generally designated 14, and front and back walls 16 and 18. The front and back walls are joined to each other by upper and lower seams 20, 22, shown symbolically as track marks, respectively provided across top and bottom ends 12 and 14 of the bag. Lateral edges of the rectangular sheet of film material from which the bag body is formed are joined to each other along a back seam 24 extending vertically along back wall 18. The seams 20, 22, and 24 can be formed adhesively, or by heat-sealing as is known in the art. The seams are advantageously continuous seals. As will be appreciated, a bag configured in accordance with the present invention can be formed from two rectangular sheets of bag material joined at their peripheral regions to form a package, with the fastener assembly having a length corresponding to the width of the sheet of bag material to which the fastener assembly is joined.

Reclosable bag 10 includes profile strip fastener assembly 26 which is sealingly mounted on the inside surface of front wall 16. In order to permit use of the present bag with conventional packaging equipment, fastener assembly 26 has a length no more than one-half the width of the rectangular sheet of film material from which the bag body is formed. In practice, a substantially continuous sheet of film material is provided with a plurality of the fastener assemblies 26 mounted thereon at spaced locations, which spacing corresponds to the length dimension of the bags ultimately to be formed (See FIG. 10). For use, this web of film material (with the fastener assemblies mounted thereon) is supplied to a form, fill, and seal apparatus which operates to form a series of the bags 10, in end-to-end relationship, by formation of back seam 24, bottom seam 22, and top seam 20, as food product is supplied to the individual bags being formed. After formation and filling, the individual bags are ordinarily separated from each other for packaging and shipment, as may be required.

The fastener assembly 26 includes a first elongated profile strip 28, and a second elongated profile strip 30 which are configured for releasable interlocking engagement with each other. While the specific configuration of the profile strips can be varied while keeping with the principles disclosed herein, it is contemplated that one of the profile strips (first strip 28 in the illustrated embodiment) includes a body 32 which defines at least one elongated groove, such as two grooves 34*a*, 34*b*, while the other profile strip (second strip 30) includes a body 36 which defines at least one protuberance, such as two protuberances 38*a*, 38*b*, configured for respective interlocking engagement with the grooves 34*a*, 34*b*. As will be recognized by those familiar with the art, the number of grooves and protuberances, and their respective disposition on the first and second profile strips, can be varied while keeping with the principles disclosed herein.

The fastener assembly 26 is sealingly mounted on the inside surface of the front wall 16 of the body of the reclosable bag 10, and to this end, each of the profile strips 28, 30, includes an elongated flange portion joined to the inside surface of the front wall. Specifically, first profile strip 28 includes a body flange portion 40 which is joined to the inside surface of front wall 16 by elongated upper seal 41 shown as track marks across a partial width of the front wall 16. Similarly, second profile strip 30 includes a body flange portion 42 (including upper and lower flange regions 42*a*, 42*b* which respectively extend upwardly and downwardly from the body 36) which is joined to the inside surface of front wall 16 by lower elongated seal 43 and elongated intermediate seal 44 both shown as track marks across a partial width of the front wall 16. Elongated seal regions 41, 44 are connected by an end seal region 50 shown as track marks along a vertical direction. It is within the purview of the present invention that seal regions 41, 43, 44, 50 may be formed with the use of suitable adhesive, but are preferably provided by heat-sealing (sometimes referred to as"lock-up" or "destruct" sealing). The seals 41, 43, 44, 50 are preferably continuous for strength and for sealing of the contents of the bags, but discontinuous seals may be suitable for some applications.

The flange portions of the first and second profile strips 28, 30 may be unitary with the respective body of the profile strip by formation of the flange portion from the same piece of material as the respective body. As disclosed herein, it is within the purview of the present invention that at least one of the flange portions of the profile strips be formed from material which differs from that from which the respective body of the profile strip is formed. The configuration of the present package can be desirable for use with certain perishable products that must be packaged in a manner which limits the amount of oxygen to which the products are exposed. For packaging of such products, the bodies 32, 36 of the first and second profile strips can be separately manufactured, and the flange portions 40, 42, thereafter respectively attached to the bodies. The bodies of the profile strips are normally produced from low pressure polyethylene due to the close tolerances required for the desired interlocking relationship of the components, and for ease of manufacturing. In contrast, the flange portions of the profile strips can be formed from material which is substantially different from low pressure polyethylene for relatively low oxygen transmission, such as materials including nylon, EVOH (ethylene vinyl alcohol), or the like.

It is presently preferred that the body flange portion 40 of first profile strip 28 be positioned in substantially flush and coextensive relationship with that surface of the body 32 which defines the grooves 34*a*, 36*b*. In this preferred arrangement, as shown in FIG. 1A, sealing of the ends of the profile strips to each other is preferably effected to facilitate handling of the strips prior to securement to the associated film material of the bag body. The nature of the profile strips 28, 30 is such that the interlocking portions of the strips can be configured to provide desirably high load-carrying characteristics, while at the same time still being readily manually detached from each other. However, in order to desirably reduce the stress to which the interlocked profile strips are subjected during bag formation and filling, and subsequent handling, the fastener assembly embodying the principles of the present invention includes a secondary, peelable seal which detachably joins the profile strips to each other, apart from the releasable engagement of protuberances 38*a*, 38*b* in the grooves 34*a*, 34*b*.

Figure 1:
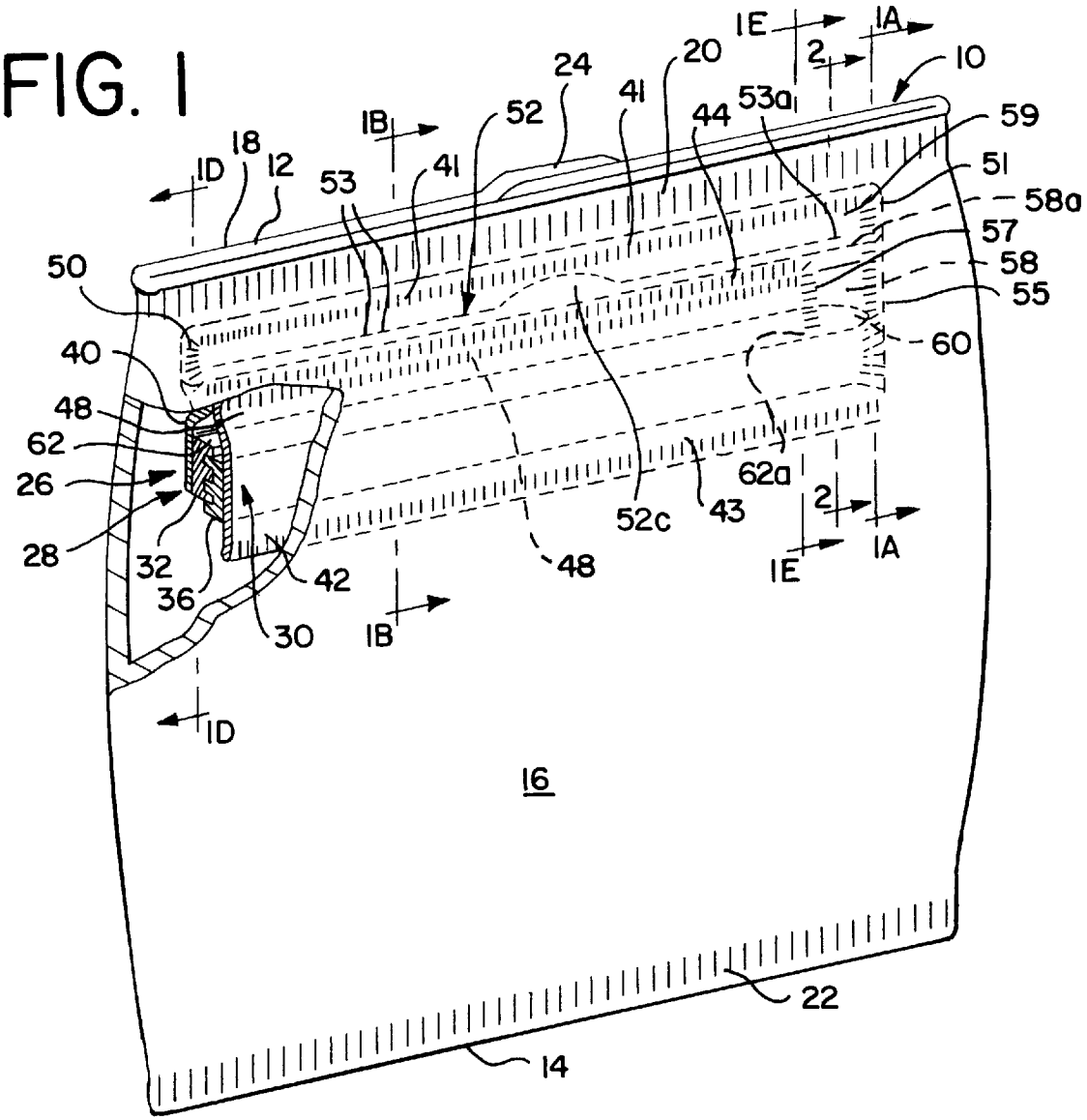
FIG. 1 is a perspective partially cut-away view of a package in the form of a reclosable bag embodying the principles of the present invention.
Figure 1B:
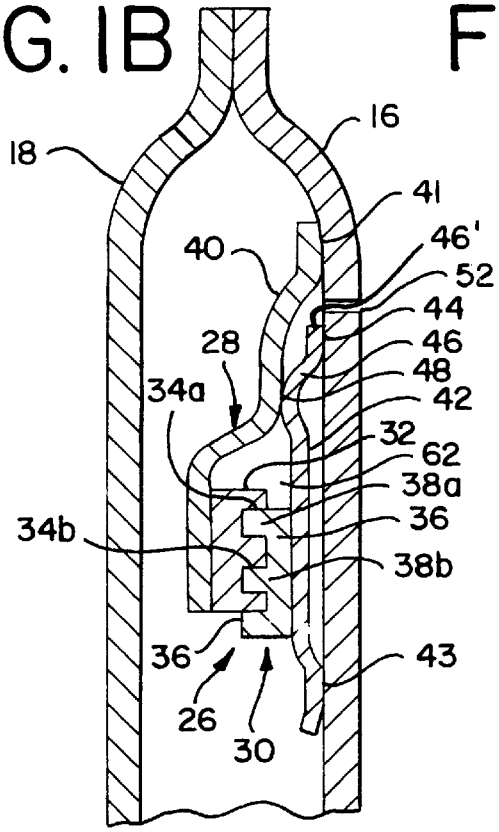
FIG. 1B is a fragmentary sectional view taken generally along line 1B—1B of FIG. 1.

In the illustrated embodiment, as illustrated in FIG. 1B, this secondary securement is provided by the provision of a seal flange portion 46 extending upwardly from the body flange portion 42 of second profile strip 30, with a peelable seal 48 provided between the seal flange portion 46 and the body flange portion 40 of first profile strip 28. In the preferred form, the peelable seal 48 is provided in spaced relationship to an edge 46' of seal flange portion 46. Peelable seals such as seal 48 are configured to peel open easily using minimal opening forces by utilizing low sealing temperatures, reduced dwell times, and light sealing pressures. Peelable seals can also be produced by utilizing a single polymer or from a combination of polymers that molecularly produce low seal strengths. A peelable seal can also be formed by selectively treating one or both of the flange portions of the profile strips, at least in the region at which the peelable seal is to be formed (such as by the localized application or coating of adhesive or like material). This aspect of the present invention provides desired versatility, since it is contemplated that the peelable seal will be formed on the same side of the flange portion 40 which is secured to the inside surface of the associated bag body by upper seal 41. While peelable seal 48 can be pre-formed as part of the fastener assembly 26 prior to its securement to the web or during its securement to the web from which bag 10 is formed, it may be desirable for some applications to form peelable seal 48 at the time of filling of the bag.

As will be appreciated, the peelable seal 48 preferably is configured to extend substantially the entire length of the fastener assembly 26, except within a vent passage as described below, thus desirably acting to provide an additional seal for the contents of the bag 10 in addition to the seal provided by interlocked portions 34*a*, 34*b*, 38*a*, 38*b* of the profile strips 28, 30. Further sealing of the contents of the bag against air and moisture transmission is preferably effected by the provision of the end seal 50 at one end of the fastener assembly 26, and by an end seal 51 at an opposite end.

Figure 1C:
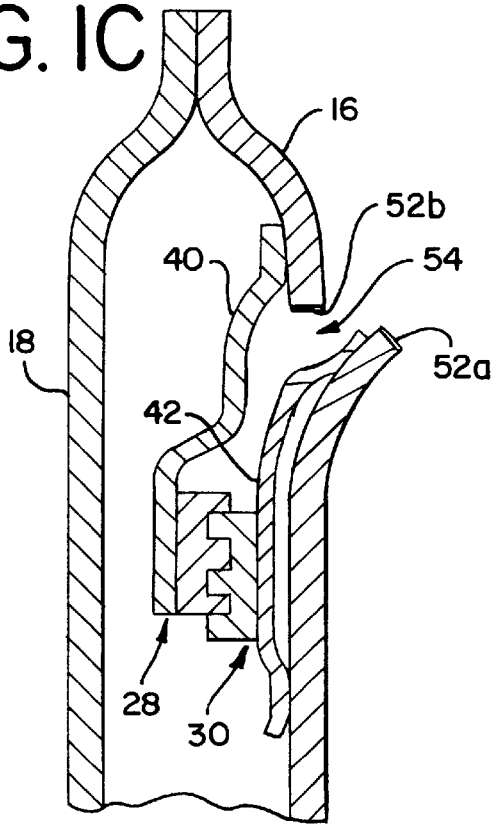
FIG. 1C is a fragmentary sectional view of the bag shown in FIG. 1A in an opened condition.

As illustrated in FIGS. 1, 1B and 1C, access to the fastener assembly 26 from the exterior of the package is preferably provided by the provision of an elongated, frangible region, substantially aligned with fastener assembly 26, and in particular in the region between edge 46' and upper seal 41. In the illustrated embodiment the frangible region comprises an elongated frangible joint 52 formed through the front wall 16 of the bag body.

The joint 52 is preferably defined by a preferentially weakened frangible portion of the bag front wall 16, such as by perforations 53, resulting in formation of an elongated opening 54 by which access to fastener assembly 26 is provided as illustrated in FIG. 1C. The frangible joint separates into free ends 52*a*, 52*b*. As shown in FIG. 1, the joint has an arcuate center region 52*c* which, when separated, forms a convenient tab for handling by the user to pull apart the opening 54. Opening of the joint 52 permits peelable seal 48 to be readily opened. After separation and opening of seal 48, profile strips 28, 30 can be easily separated by disengagement of protuberances 38*a*, 38*b* from grooves 34*a*, 34*b*, thus permitting access to the contents of the package.

The intermediate seal 44, as shown, is located above the peelable seal 48 and the protuberances 38*a*, 38*b*, and the grooves 34*a*, 34*b*. However, it will be appreciated that seals 44 and 48 can be aligned with each other by simultaneous formation of the two seals. The seals 41, 44 are preferably continuous with the end seal 50. The upper seal 41 is preferably continuous with the opposite end seal 51.

By providing the seals 41, 44 closely surrounding the frangible joint 52, a large and rigidifying seal can be avoided and only a thin surrounding seal can be used. Since seals 41, 44 are positioned on the same side of the profile strips (i.e., above the strips in the illustrated embodiment) a hermetic seal can be formed about the access opening (provided by joint 52) without the need to hermetically seal the bodies of the profile strips to each other and to the inside surface of the bag body. Additionally, due to the fact that the seal 44 is located on the edge of the body flange portion 42, and the seal 41 is located along an opposite lateral edge of the body flange portion 42, the profile strip 30 is more stably supported across its vertical dimension as shown in FIG. 1B. Particles, such as particles from the bag contents, cannot become trapped between the body flange portion 42 and the front wall 16 of the bag body. The body flange portion is held in place for accurate engagement of the two strips 28,30.

Figure 1D:
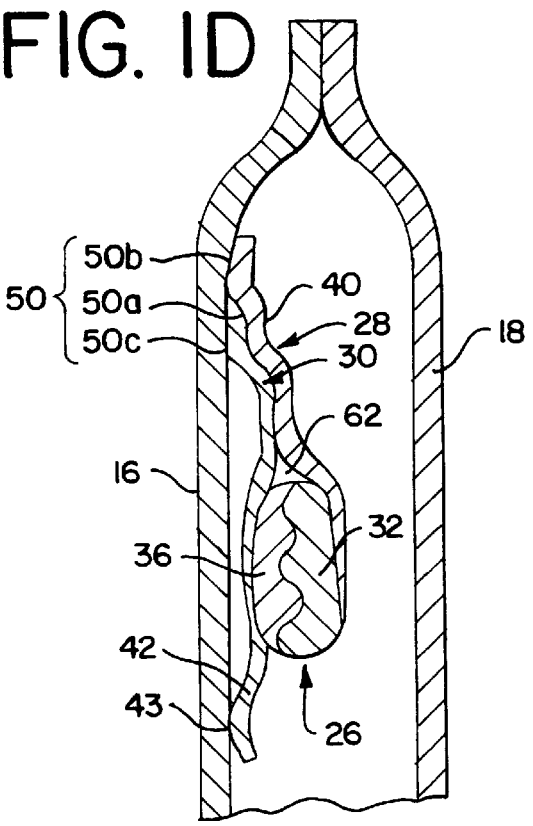
FIG. 1D is a fragmentary sectional view taken generally along line 1D—1D of FIG. 1.

The end seal 50, as illustrated in FIG. 1D, desirably act to sealingly join respective upper portions of lateral opposite ends of body flanges 40, 42 of the profile strips 28, 30 to each other at the interface 50*a*. As will be recognized, the end seal 50 can be formed to also seal the end of the body flange portion 40 along the interface 50*b* to the inside surface of the front wall 16, and to seal the end of the body flange portion 42 along the interface 50*c* to the inside surface of the front wall 16. The peelable seal 48 acts with the end seal 50 to substantially completely seal the region of the reclosable bag at which the fastener assembly 26 is provided (this can be desirable when the body of the bag is perforated to provide access to fastener assembly 26, as described below), except within the vent passage as described below. The three sealing interfaces 50*a*, 50*b*, 50*c* are generally located within the end seal 50 as shown in FIG. 1D.

Additionally, as shown in FIGS. 1A and 1D, at the lateral opposite end of the fastener assembly, the fastener bodies 32,36 are flattened and sealed together to prevent slippage of the profile strips 30, 28, thus avoiding any potential misalignment when reclosing the fastener assembly 26.

Opposite the end seal 50 across a length of the fastener assembly 26, is the opposite end seal 51 which is shown as track marks aligned vertically in FIG. 1. The end seal 51 extends from the upper seal 41 downwardly to an elevation 55 at about the elevation of the fastener bodies 32, 36. As shown in FIG. 1A, the end seal 51 includes a seal 51*a* between the body flange portion 40 and the body flange portion 42 downward to about the elevation 55, a seal 51*b* between a top portion 40*a* of the body flange 40 to the front wall 16 of the bag, and a seal 51*c* between an upper region 42*a* of the body flange portion 42 and the front wall 16 downward to about the elevation 55. These three overlapping seal interfaces can be sealed simultaneously by the application of an adhesive and\or heat substantially from a top end 56 to the elevation 55.

Arranged extending from the intermediate seal 44 downwardly is a passage defining seal 57, shown as track marks extending vertically in FIG. 1. The passage-defining seal 57 extends down to about the elevation 55 and seals the body flange portion 40 to the body flange portion 42 and the front wall 16. The end seal 51 and the passage-defining seal 57 together define a vent passage 58 extending upwardly from near the profile elements 32, 36 into a volume 59. The volume 59 is contained between the seals 57, 51, 50, 44, 41 and is exposed to ambient air through the perforations 53 of the perforated joint 52. An enlarged perforation 53*a* can be provided to assist venting. Although the vent passage is arranged adjacent the end seal 51, the invention contemplates the vent passage 58 could be located anywhere between the end seals 50, 51 along the intermediate seal 44 and defined by two passage-defining seals 57 extending downwardly from the intermediate seal 44.

As shown in FIG. 1A, despite the deformation of the bodies 32, 36 and the presence of the elongated end seal 51, a triangular-shaped gap 60 remains which exposes the inside bag atmosphere to a top side of the fastener bodies 32, 36. The gap 60 is open directly into the vent passage 58.

Figure 1E:
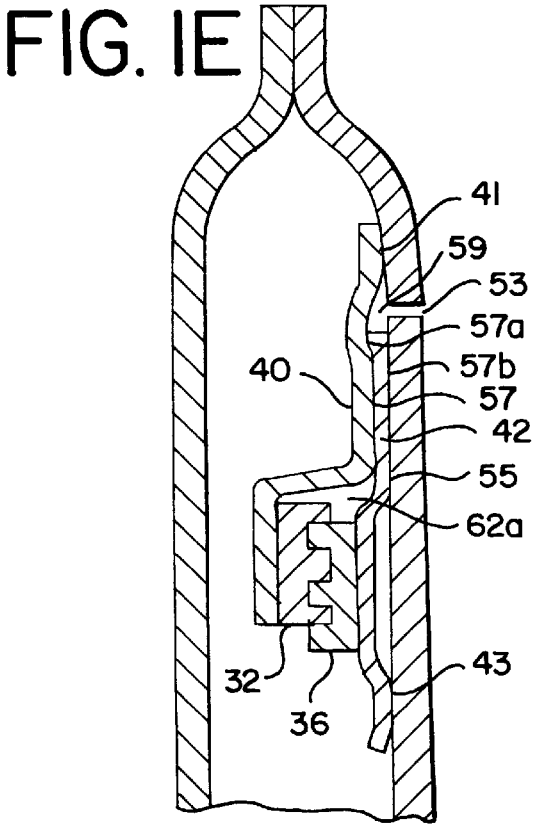
FIG. 1E is a fragmentary sectional view taken generally along line 1E—1E of FIG. 1.

As illustrated in FIG. 1D, a substantially triangular channel 62 begins below the end seal 50 and above the fastener bodies 32, 36 at an opposite lateral end of the fastener 26. As shown in FIG. 1B, the channel 62 is somewhat enlarged at a distance inward from the end seal 50 along the length of the profile strip assembly and is delimited at an upper end by the peelable seal 48. As illustrate in FIG. 1E, the channel 62, is slightly constricted at a channel opening 62*a* at the passage-defining seal 57. At this point according to FIGS. 1 and 1E the channel opening 62*a* opens directly into the vent passage 58. Thus the vent passage 58 is in gas flow communication with the contents of the bag body through the gap 60 and the channel opening 62*a*.

As can be seen in FIG. 1, the peelable seal 48 which is applied between the body flange portions 40, 42 is discontinued throughout a width 58*a* of the vent passage 58. However it may be advantageous to provide a peel seal material across the width 58*a* of the vent passage 58 in continuation of the peelable seal 48 as shown, the portion of the peel seal material within the vent passage being non-heat activated, which material provides a flexible and conformable seal interface without being adherent ("sticky"). Although, the seal interface could be made adherent by one or both of the body flange portions 40, 42 including a blocking agent such as an ionomer or tackified EVA (ethylene vinyl acetate) or like material applied across the vent channel 58 on one or both facing surfaces of the body flange portions 40, 42 to facilitate sealing or sticking together, to ensure the air tight closing of the vent under reversed pressurized bag conditions. A drop of silicon oil or the like can also be used to ensure that vent channel 58 closes off air tightly.

Figure 2:
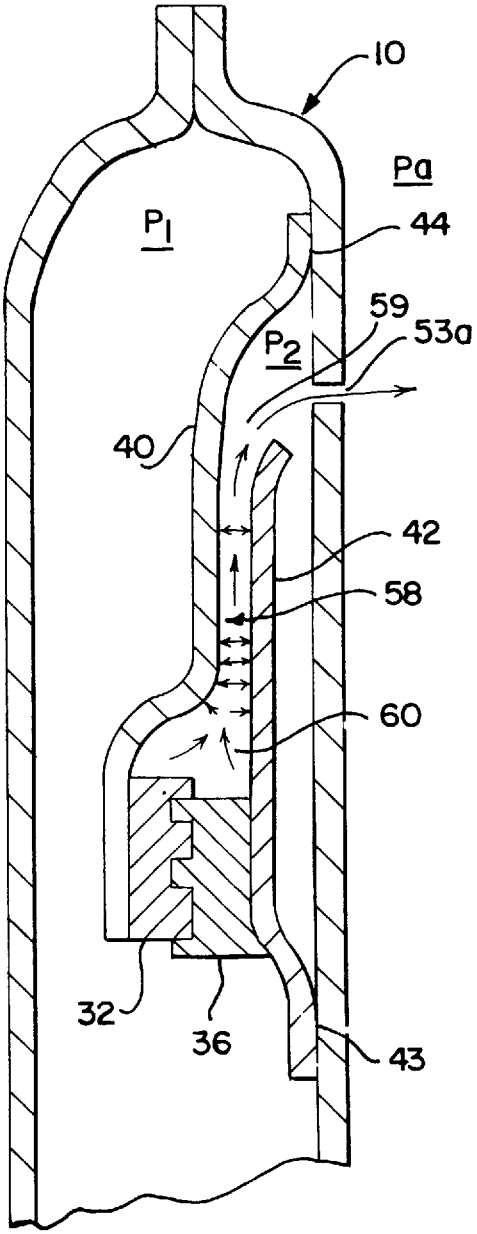
FIG. 2 is a fragmentary cross-sectional view taken along lines 2—2 of FIG. 1 in a first mode of operation.

FIG. 2 illustrates the operation of the present invention for the case where pressure within the bag 10 exceeds atmospheric pressure such as by the evolving of carbon dioxide gas from coffee beans stored within the bag 10. Under these conditions, the gas generated will proceed transversely through the channel 62 and opening 62*a* and the gap 60 (into and out of the plane of FIG. 2) and enters the vent passage 58. Since the flange 42 is not sealed across the vent passage 58, the higher pressure P1 acts to open the passage 58 to expel gas to a lower pressure P2 within the volume 59 which is approximately equal to atmospheric pressure Pa. Pressure thus acts to spread the body flange portion 42 from the body flange portion 40 in the vent passage 58 to open the passage 58 for expelling the gas. The expelled gas discharges through the apertures 53, 53*a*.

Some products, such as coffee beans, after a period of time undergo a reverse pressure effect, wherein oxygen within the bag is absorbed by the coffee beans creating a potential vacuum within the package. Such a vacuum would cause a suction of ambient air into the package through any available opening if not prevented. The vent structure of the present invention is a one-way vent which prevents such an ingress of air.

Figure 3:
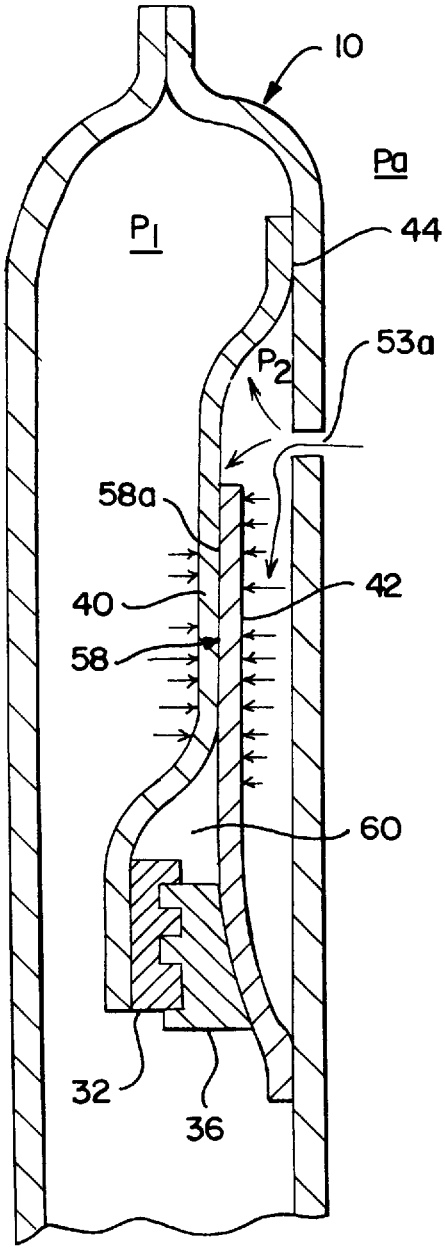
FIG. 3 is a fragmentary cross-sectional view of the reclosable bag of FIG. 2 but in a second mode of operation.

As illustrated in FIG. 3 in accordance with the present invention, when the pressure P2, which is approximately equal to atmospheric pressure Pa, is greater than the pressure P1 within the bag 10, a net suction occurs which closes the body flange portion 42 against the body flange portion 40 to seal off the vent channel 58 to prevent passage of air into the package.

Figure 4:
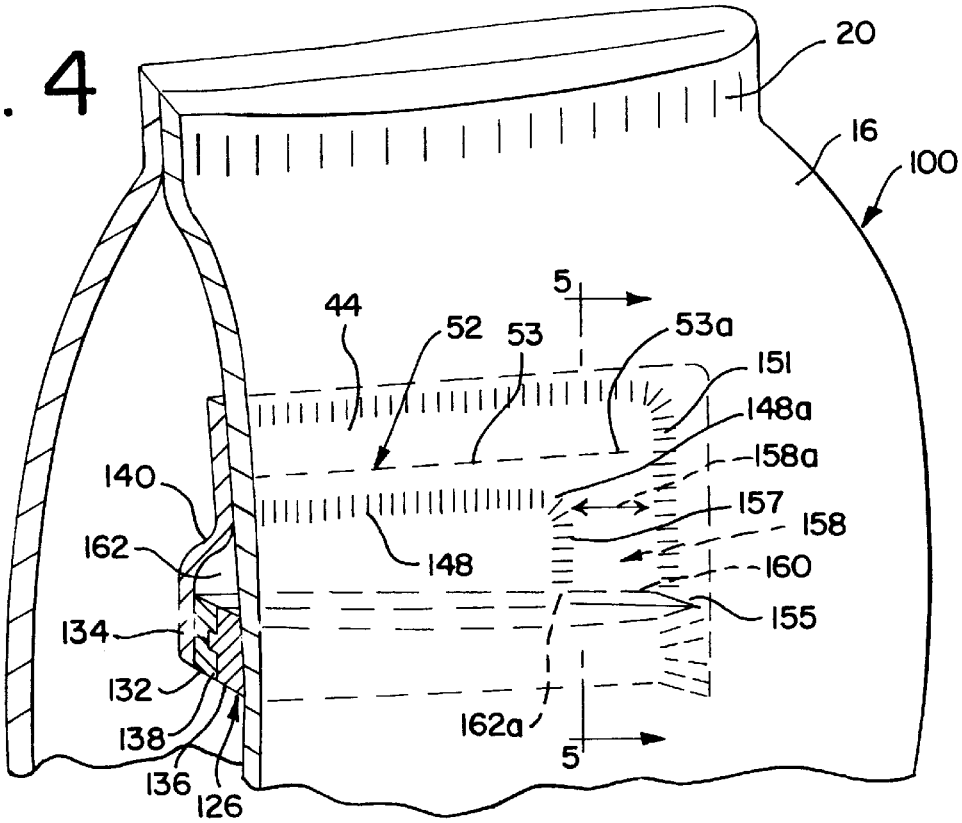
FIG. 4 is an enlarged fragmentary perspective partially cutaway view of an alternate embodiment package in the form of a reclosable bag embodying the principles of the present invention.

FIG. 4 illustrates an alternate embodiment bag 100 wherein an alternate fastener assembly 126 has a first fastener body 132 including a single groove 134, locked to a second fastener body 136 by a single protrusion 138 thereof. The second fastener body 136 is directly secured to the bag wall 16. The first fastener body 132 is secured to or formed with a body flange portion 140. The body flange portion 140 is sealed to the bag wall 16 by the top seal 44 as previously described, and by an end seal 151, shown as vertically aligned track marks. The end seal 151 extends from the upper seal 44 down to an elevation 155. A peelable seal 148, shown as horizontally aligned track marks, extends from an opposite end seal (not shown) of the bag to a corner 148*a* at a short distance from the end seal 151. The opposite end seal (not shown) is similar in appearance to the end seal 50 shown in FIG. 1, and connects the top seal 44 to the peelable seal 148 in a relatively short vertical span. A passage-defining seal 157, which seals the body flange portion 140 to the wall 16, extends downward from the corner 148*a* to approximately the elevation 155.

To access contents in the bag, the perforated junction 52 is broken, the peelable seal 148 is separated and the elements 132,136 are then separated. The vent channel 158 is thus defined between the vertical seals 151, 157.

A gap 160 is formed between the body flange portion 140, the top of the fastener bodies 132, 136 and the front wall 16, at the position of the end seal 151. The gap is similar in shape to the gap 60 shown in FIG. 1A. A channel 162 extends from a lateral end opposite the seal 151, above the fastener bodies, and between the body flange portion 140 and the front wall 16 and terminates in a channel opening 162*a* open into the vent passage 158. The channel 162 is similar in shape to the channel 62 shown in FIGS. 1D and 1E. The body flange portion 140 and/or the front wall 16 can be treated to prevent or facilitate sticking together in the vent passage 158, particularly across the width 158*a*, as described with respect to the vent passage 58 of the previously described embodiment.

Figure 5:
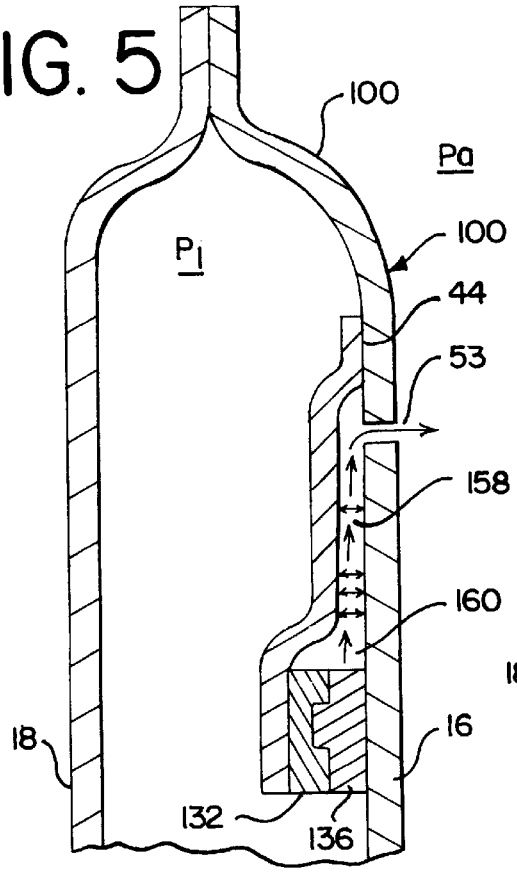
FIG. 5 is a fragmentary cross-sectional view taken along lines 5—5 of FIG. 4 in a first mode of operation.

As described in FIG. 5 when the pressure P1 inside the bag 100 is greater than atmospheric pressure Pa, due to gas generation within the package 100, the gas is passed from opposite ends of the fastener bodies 132, 136 through the gap 160 and through the channel 162 and upward through the vent passage 158 to be dispersed through the perforations 53, 53*a* as previously described.

Figure 5A:
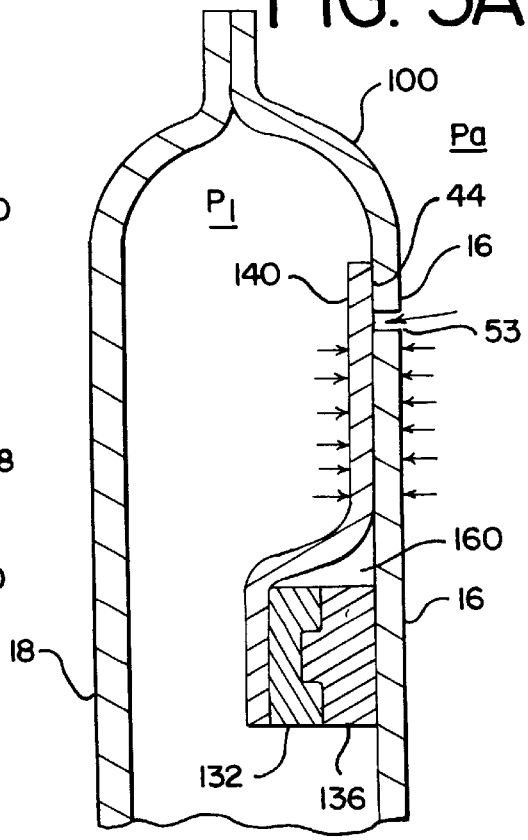
FIG. 5A is a fragmentary cross-sectional view of the reclosable bag of FIG. 5 but in a second mode of operation.

As illustrated in FIG. 5A when atmospheric pressure Pa is greater than the pressure P1 within the bag 100, due to oxygen absorption by the product within the package, a squeezing shut occurs between the body flange portion 140 and the front wall 16 to close the apertures 53, 53*a* against the body flange 140, to prevent any air flow into the package.

Figure 6:
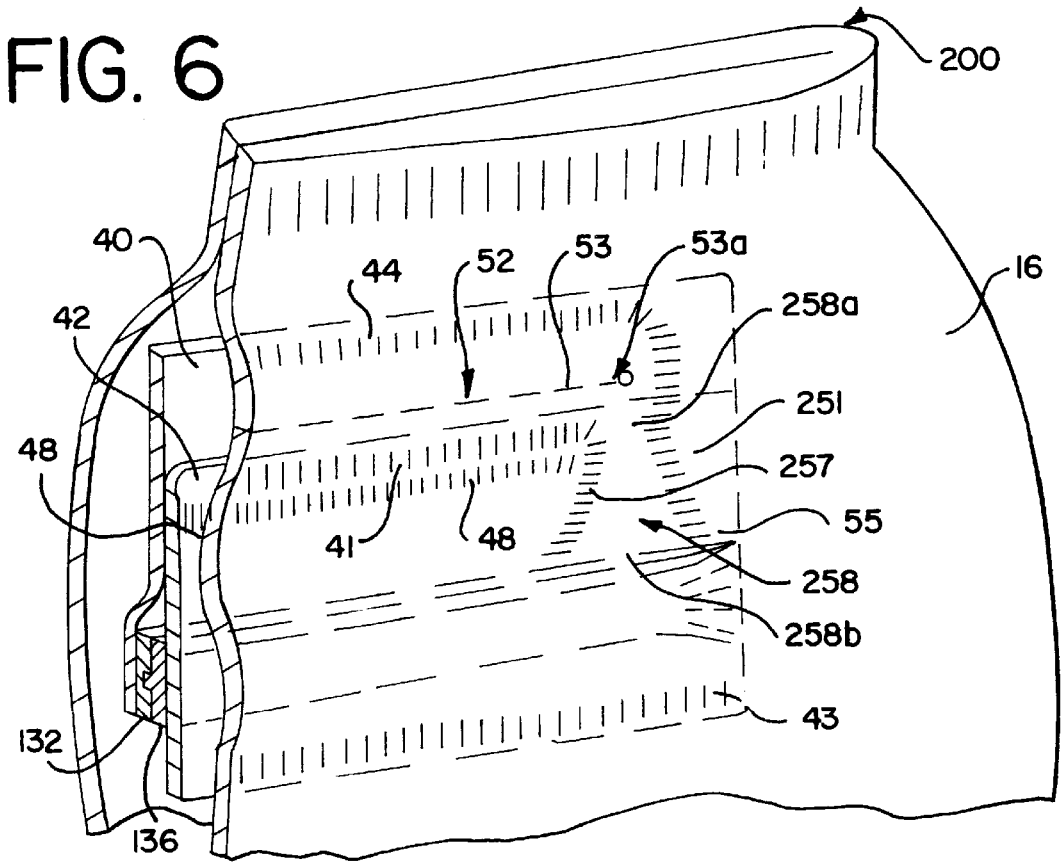
FIG. 6 is a fragmentary perspective view of a second alternate embodiment of the present invention.

FIG. 6 illustrates an alternative embodiment bag 200. The bag 200 is substantially identical to the bag 10 shown in FIG. 1 except that the end seal 251 and the passage-defining seal 257, shown symbolically as track marks, flare away from each other from an upper width 258*a* to a lower width 258*b* of a vent passage 258. The upper width 258*a* is at the elevation of the intermediate seal 41. The peelable seal 48, as in FIG. 1, extends up to the passage-defining seal 257, and the vent passage 258 is otherwise free of seals across its width. It is anticipated that the flared shape of the vent passage 258 will promote the egress of gas while inhibiting the ingress of air.

Figure 7:
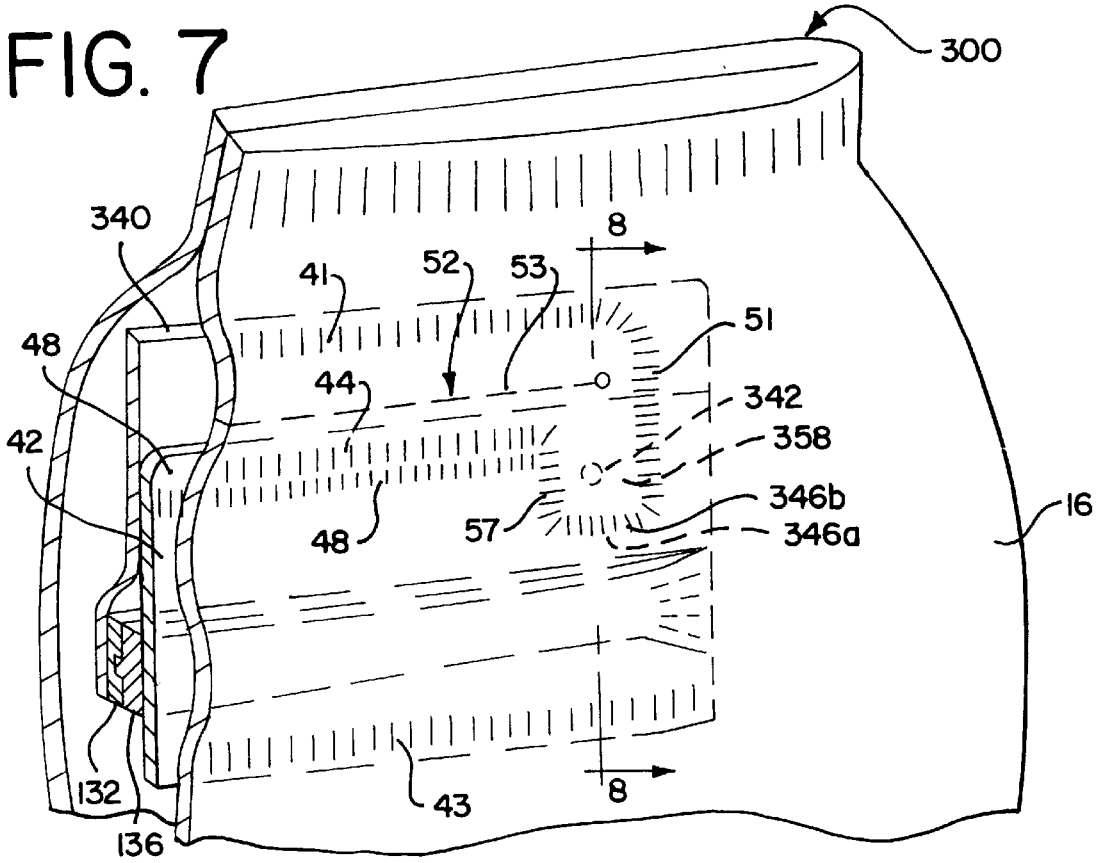
FIG. 7 is a fragmentary perspective view of a third alternate embodiment of the present invention.
Figure 9:
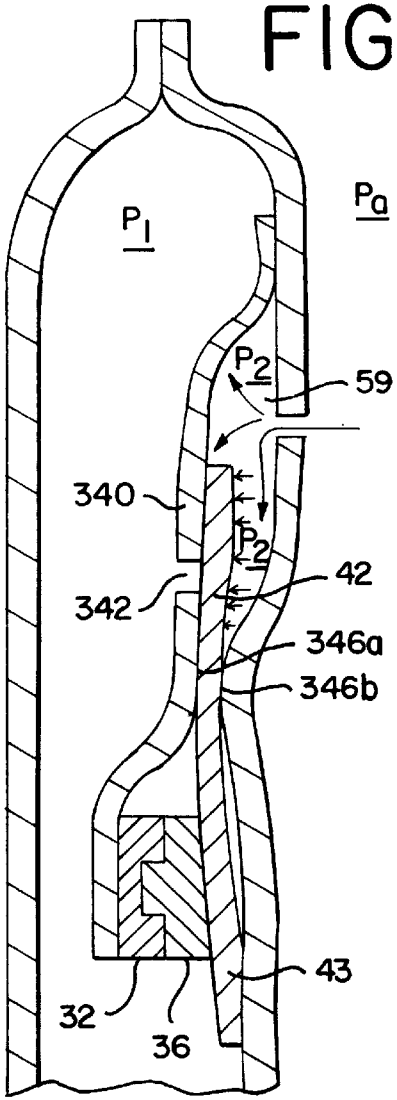
FIG. 9 is a fragmentary sectional view of the bag shown in FIG. 8 in a second mode of operation.
Figure 8:
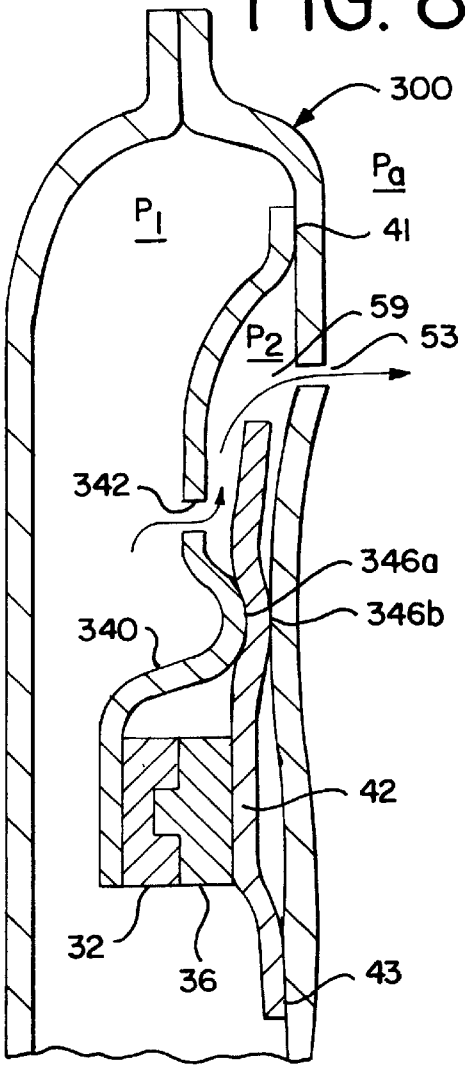
FIG. 8 is a fragmentary sectional view taken generally along 8—8 of FIG. 7, in a first mode of operation.

FIGS. 7–9 illustrate a further alternate embodiment bag 300 to the embodiment of FIG. 1. The embodiment of FIG. 7 is substantially identical to that of FIG. 1 except that a first body flange portion 340 is provided which carries the body 32, and which has a hole 342 therethrough. Also, the first body flange portion 340 is additionally sealed to the second body flange portion 42 of the bag 300 across a bottom seal 346*a* and the second body flange portion 42 is additionally sealed to front panel 16 across a bottom seal 346*b* between the passage-defining seal 57 and the end seal 51. In this embodiment, except for the hole 342, the body flange portions 42, 340 are sealed all around the junction 52 by the seals 50, 41, 44, 51, 57, and beneath the junction by the peelable seal 48, and bottom seal 346 to form a hermetic seal. The bottom seal 346*a* can also be a peelable seal.

As demonstrated in FIG. 8, when the inside bag pressure P1 is greater than the pressure P2 inside the volume 59 (P2 being approximately equal to atmospheric pressure Pa), gas from within the bag 300 will flow through the hole 342, through a vent passage 358, into the volume 59 and out through the perforations 53, 53*a*.

As shown in FIG. 9, when the pressure P1 within the bag 300 falls below atmospheric pressure Pa, the pressure P2 (approximately equal to Pa) within the volume 59 causes the second body flange portion 42 to be pressed to the first body flange portion 340 to close the hole 342. Thus, for example, if product within the bag 300 absorbs oxygen to depress the pressure therein, air will be prevented from entering the bag. A drop of silicone oil or the like can be applied to the second body flange portion 42 facing the first body flange portion 340 and in registry with the hole 342, and slightly larger in size than the hole 342, to ensure that the hole closes off air tightly.

It is to be understood that while only one vent channel 58, 158, 258, 358 and associated seals, and in one case a hole 342, is shown for each embodiment, it is contemplated by the invention to provide plural vent channels such as one vent channel at each end of the fastener assembly 26, 126. Plural vents reduce the size of each vent channel to minimize the possibility of particles such as ground coffee from leaking but at the same time providing a large enough passage to vent gas at a low pressure.

Figure 10:
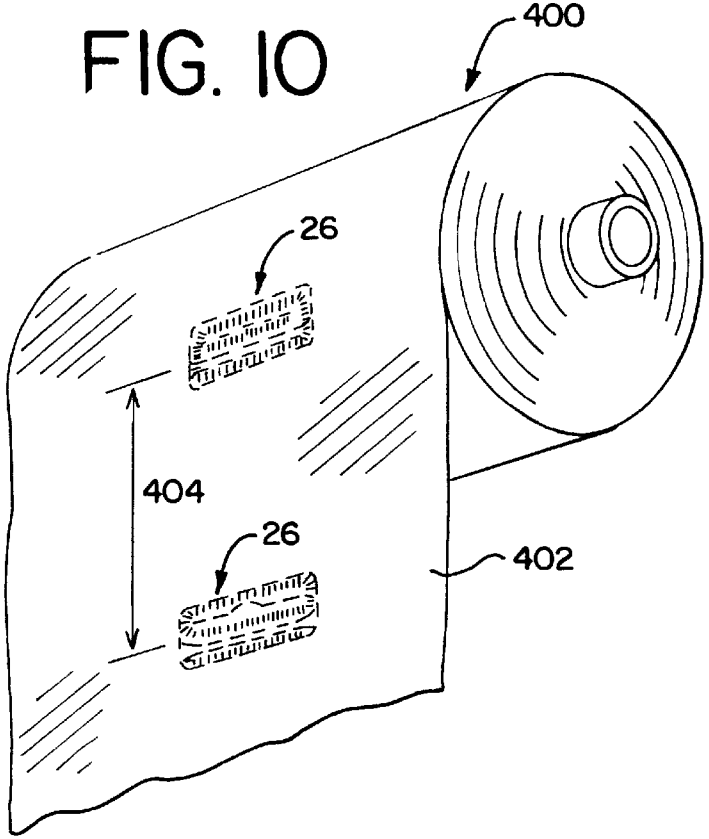
FIG. 10 is a perspective view of a rolled film with attached fastener assemblies.

FIG. 10 illustrates a rolled stock 400 of bag making film 402 having fastener assemblies 26 (or alternatively 126) attached thereto at intermittent spacing 404. The film 402 can be used as feed stock for a form, fill and seal machine with the spacing 404 corresponding in length to a length of each finished bag.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover by the appended claims all such modifications as fall within the scope of the claims.

What is claimed is:

1. A bag body formed from a rectangular sheet of film material, said bag body having:

a top end, a bottom end, a front wall, and a back wall, said front wall being joined to said back wall by upper and lower seams respectively provided at said top and bottom ends; and a reclosable fastener assembly joined to said front wall and comprising first and second interlocking profile strips respectively extending along the length of the fastener assembly, said profile strips being configured for releasable interlocking engagement with each other by the provision of at least one protuberance on one of said profile strips, and at least one groove defined by the other of said profile strips for respectively releasably receiving said protuberance;

said first profile strip including a first body flange portion joined at a first seal to an inside surface of said front wall of said bag body, said second profile strip joined by a second seal to the inside surface of said front wall of said bag body, a gas bypass opening provided around said interlocking engagement of said profile strips, said front wall including an openable joint between said first and second seals;

said front wall having a vent opening therethrough; and a vent passage formed by said first body flange portion and said vent opening through said front wall, said vent passage being openable under influence of internal bag pressure to expel gas from inside said bag body from said gas bypass opening to outside said bag through said vent opening.

2. The bag body according to claim 1, wherein said second profile strip includes a seal flange portion, said fastener assembly includes a peelable seal formed between and joining said seal flange portion to said body flange portion so that said peelable seal must be opened to provide access to an opening between said first and second profile strips when they are released from interlocking engagement with each other.

3. The bag body according to claim 1, wherein said joint includes elongate, frangible access means formed into said front wall of said bag body and substantially aligned with said fastener assembly.

4. The reclosable bag body according to claim 3, wherein said frangible access means includes perforations through said front wall of said bag body and said vent passage is in gas flow communication with said perforations.

5. The reclosable bag body according to claim 4, wherein said vent passage is defined by a free portion of said first body flange portion which is unsealed to said inside surface of said front wall and sealed along lateral edges to said front wall by passage defining seals which are angled from said first seal.

6. The reclosable bag body according to claim 5 wherein said passage-defining seals diverge from each other in a direction way from the first seal.

7. The reclosable bag body according to claim 5, wherein said gas bypass opening comprises a channel formed between said interlocking engagement of said protuberance and said groove, and said peelable seal, said channel in gas flow communication with said vent passage.

8. The reclosable bag body according to claim 7, wherein said channel comprises an opening between said first body flange portion and said front wall at an end seal of said first body flange portion to said front wall, said end seal located at an end of said profile strips along a length direction thereof.

9. The reclosable bag body according to claim 1, wherein said gas bypass opening is an aperture through said first body flange portion.

10. The reclosable bag body according to claim 1, wherein said second profile strip includes a second body flange portion, sealed to said front wall substantially across a width of said second body flange portion, but having a free portion across said vent passage, said vent passage defined between said first and second body flange portions, said first and second body flange portions having a peelable seal therebetween substantially across a width of the reclosable fastener assembly, with a gap in said peelable seal across the width of said vent passage.

11. A reclosable bag, comprising:

a bag body formed from at least one sheet of film material, said bag body having:

a top end, a bottom end, a front wall, and a back wall, said front wall being joined to said back wall by upper and lower seams respectively provided at said top and bottom ends; and a reclosable fastener assembly joined to said front wall and comprising first and second interlocking profile strips respectively extending along the length of the fastener assembly, said profile strips being configured for releasable interlocking engagement with each other by the provision of at least one protuberance on one of said profile strips, and at least one groove defined by the other of said profile strips for respectively releasably receiving said protuberance, said first profile strip including a first body flange portion joined along an upper edge at a first seal to said front wall of said bag body and said second profile strip including a second body flange portion joined at a second seal to said front wall of said bag body, said second seal formed along an upper edge of said second profile strip, said first seal located above said second seal, at least one perforation through said front wall located between said first and second seals, said first and second body flange portions also substantially sealed along opposite vertical edges to said front wall of said bag body, said second seal having a vent passage along a length thereof wherein said second body flange portion is unsecured to said front wall; and one of said first and second profile strips including a seal flange portion, said fastener assembly including an peelable seal formed between and joining said seal flange portion of said one profile strip and the other one of said profile strips, said peelable seal located between said second seal and said protuberance, at least one gap provided between said profile strips and said peelable seal which opens into said bag body.

12. A reclosable bag in accordance with claim 11, wherein said seal flange portion of said one profile strip is joined by said peelable seal to the body flange portion of the other one of said profile strips.

13. A reclosable bag in accordance with claim 11, wherein said front wall of said bag body includes an elongated joint formed by perforations and substantially aligned with said fastener assembly for providing access to said fastener assembly after opening of said joint, said vent passage in gas flow communication with said perforations.

14. A reclosable bag in accordance with claim 11, including a pair of end seals at respective opposite ends of said fastener assembly for joining respective ends of said profile strips to each other, said gap formed by spaces between said profile strips at said end seals.

15. A reclosable bag in accordance with claim 11, wherein said bag body is formed from a single sheet of film material, with lateral edges of said rectangular sheet of film material from which said bag body is formed joined to each other along a back seam extending along said back wall, said fastener assembly having a length no more than one-half the width of said rectangular sheet of film material.

16. A reclosable bag, comprising a bag body formed from at least one sheet of film material, said bag body having a top end, a bottom end, a front wall, and a back wall, said front wall being joined to said back wall by upper and lower seams respectively provided at said top and bottom ends; and a reclosable fastener assembly joined to an inside surface of said front wall and comprising first and second interlocking profile strips respectively extending along the length of the fastener assembly, said profile strips being configured for releasable interlocking engagement with each other by the provision of at least one protuberance on one of said profile strips, and at least one groove defined by the other said profile strips for respectively releasably receiving said protuberance, said first profile strip including a first body flange portion joined to said front wall of said bag body, and said second profile strip including a second body flange portion having upper and lower regions joined to said front wall of said bag body, seal means joining said first body flange portion of said first profile strip and the upper region of said second body flange portion of said second profile strip to said bag body, said bag body including an access opening defined by a group of perforations, said seal means extending about said group of perforations to form a hermetic seal; and a one-way vent in gas flow communication with said perforations and an inside of said bag body through said seal means.

17. A reclosable bag in accordance with claim 16, wherein said first body flange portion of said first profile strip is joined by a peelable seal to the second body flange portion of said second profile strip.

18. A reclosable bag in accordance with claim 16, including a pair of end seals at respective opposite ends of said fastener assembly for joining respective ends of said profile strips to each other, gaps between said profile strips at said end seals being in gas flow communication with said one-way vent.

19. A reclosable bag in accordance with claim 16, wherein each of said profile strips includes a fastener body formed from polyethylene, with each said body flange portion of each said profile strip being formed from material which exhibits relatively low oxygen transmission.

20. A reclosable bag in accordance with claim 19, wherein said material from which said body flange portions are formed is selected from the group consisting of nylon and ethylene vinyl alcohol.

21. A film stock for use in a bag making machine, comprising:

an elongate film having a width and a length;

a plurality of fastener assemblies sealed to said film, spaced apart along the length of said film, each having first and second interlocking profile strips respectively extending along the length of the fastener assembly, said profile strips being configured for releasable interlocking engagement with each other by the provision of at least one protuberance on one of said profile strips, and at least one groove defined by the other of said profile strips for respectively releasably receiving said protuberance;

said first profile strip including a first body flange portion joined at a first seal to an inside surface of said front wall of said bag body, said second profile strip joined by a second seal to the inside surface of said front wall of said bag body, a gas bypass opening provided around said interlocking engagement of said profile strips, said front wall including an openable joint between said first and second seals;

said front wall having a vent opening therethrough; and a vent passage formed by said body flange portion and said vent opening through said front wall, said vent passage being openable under influence of internal bag pressure to expel gas from inside said bag body from said gas bypass opening to outside said bag through said vent opening.

22. The film stock according to claim 21, wherein said second profile strip includes a seal flange portion, said fastener assembly includes a peelable seal formed between and joining said seal flange portion to said first body flange portion so that said peelable seal must be opened to provide access to an opening between said first and second profile strips when they are released from interlocking engagement with each other.

23. The film stock according to claim 21, wherein said joint includes elongate, frangible access means formed into said front wall of said bag body and substantially aligned with said fastener assembly.

24. The film stock according to claim 21, wherein said vent passage is defined by a free portion of said body flange portion which is unsealed to said inside surface of said front wall and sealed along lateral edges to said front wall by passage defining seals which are angled from said first seal.

25. The film stock according to claim 24, wherein said gas bypass opening comprises a channel formed between said interlocking engagement of said protuberance and said groove, and said peelable seal, said channel in gas flow communication with said vent passage.

26. The film stock according to claim 21, wherein said gas bypass opening is an aperture through said body flange portion.

* * * * *